US010249284B2

(12) United States Patent
Kwatra et al.

(10) Patent No.: US 10,249,284 B2
(45) **Date of Patent: *Apr. 2, 2019**

(54) BANDLIMITING ANTI-NOISE IN PERSONAL AUDIO DEVICES HAVING ADAPTIVE NOISE CANCELLATION (ANC)

(71) Applicant: Cirrus Logic, Inc., Austin, TX (US)

(72) Inventors: Nitin Kwatra, Austin, TX (US); Ali Abdollahzadeh Milani, Austin, TX (US); Jeffrey Alderson, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/786,701

(22) Filed: Oct. 18, 2017

(65) Prior Publication Data

US 2018/0040315 A1 Feb. 8, 2018

Related U.S. Application Data

(63) Continuation of application No. 13/472,755, filed on May 16, 2012, now Pat. No. 9,824,677.

(Continued)

(51) Int. Cl.

*G10K 11/178* (2006.01)
*H04R 1/10* (2006.01)

(Continued)

(52) U.S. Cl.

CPC ..... *G10K 11/178* (2013.01); *H04R 1/1083* (2013.01); *G10K 2210/108* (2013.01);

(Continued)

(58) Field of Classification Search

CPC ..... G10K 11/178; G10K 11/1784; G10K 11/1788; G10K 2210/108;

(Continued)

(56) References Cited

U.S. PATENT DOCUMENTS 4,020,567 A 5/1977 Webster
4,352,962 A 10/1982 LaMothe (Continued)

FOREIGN PATENT DOCUMENTS

CN 101552939 A 10/2009
DE 102011013343 A1 9/2012

(Continued)

OTHER PUBLICATIONS

Abdollahzadeh Milani, et al., "On Maximum Achievable Noise Reduction in ANC Systems",2010 IEEE International Conference on Acoustics Speech and Signal Processing, Mar. 14-19, 2010, pp. 349-352, Dallas, TX, US.

(Continued)

*Primary Examiner* — Davetta W Goins
*Assistant Examiner* — Kuassi A Ganmavo
(74) *Attorney, Agent, or Firm* — Mitch Harris, Atty at Law, LLC; Andrew M. Harris

(57) ABSTRACT

A personal audio device, such as a wireless telephone, includes noise canceling that adaptively generates an anti-noise signal from a reference microphone signal and injects the anti-noise signal into the speaker or other transducer output to cause cancellation of ambient audio sounds. An error microphone is provided proximate the speaker to measure the output of the transducer in order to control the adaptation of the anti-noise signal and to estimate an electro-acoustical path from the noise canceling circuit through the transducer. The anti-noise signal is adaptively generated to minimize the ambient audio sounds at the error microphone. A processing circuit that performs the adaptive noise canceling (ANC) function also filters one or both of the reference and/or error microphone signals, to bias the adaptation of the adaptive filter in one or more frequency regions to (Continued)

alter a degree of the minimization of the ambient audio sounds at the error microphone.

14 Claims, 4 Drawing Sheets

Related U.S. Application Data

(60) Provisional application No. 61/493,162, filed on Jun. 3, 2011.

(51) Int. Cl.
*G10L 21/0208* (2013.01)
*G10L 21/0364* (2013.01)

(52) U.S. Cl.
CPC ..... *G10K 2210/3012* (2013.01); *G10K 2210/3017* (2013.01); *G10K 2210/3028* (2013.01); *G10K 2210/30231* (2013.01); *G10K 2210/30391* (2013.01); *G10K 2210/3226* (2013.01); *G10K 2210/507* (2013.01); *G10K 2210/508* (2013.01); *G10K 2210/511* (2013.01); *G10K 2210/512* (2013.01); *G10L 21/0208* (2013.01); *G10L 21/0364* (2013.01)

(58) Field of Classification Search
CPC . G10K 2210/3012; G10K 2210/30231; G10K 2210/30391; G10K 2210/3226; H04R 1/1083
See application file for complete search history.

(56) References Cited

U.S. PATENT DOCUMENTS 4,649,507 A 3/1987 Inaba et al.
4,926,464 A 5/1990 Schley-May
4,998,241 A 3/1991 Brox et al.
5,018,202 A 5/1991 Takahashi
5,021,753 A 6/1991 Chapman
5,044,373 A 9/1991 Northeved et al.
5,117,401 A 5/1992 Feintuch
5,204,827 A 4/1993 Fujita et al.
5,251,263 A 10/1993 Andrea et al.
5,278,913 A 1/1994 Delfosse et al.
5,321,759 A 6/1994 Yuan
5,337,365 A 8/1994 Hamabe et al.
5,347,586 A * 9/1994 Hill ..... G10K 11/178 381/71.8
5,359,662 A 10/1994 Yuan et al.
5,377,276 A 12/1994 Terai et al.
5,386,477 A 1/1995 Popovich et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,550,925 A 8/1996 Hori et al.
5,559,893 A 9/1996 Krokstad et al.
5,563,819 A 10/1996 Nelson
5,586,190 A 12/1996 Trantow et al.
5,633,795 A 5/1997 Popovich
5,640,450 A 6/1997 Watanabe
5,668,747 A 9/1997 Ohashi
5,687,075 A 11/1997 Stothers
5,696,831 A 12/1997 Inanaga et al.
5,699,437 A 12/1997 Finn
5,706,344 A 1/1998 Finn
5,732,143 A 3/1998 Andrea et al.
5,740,256 A 4/1998 Castello Da Costa et al.
5,768,124 A 6/1998 Stothers et al.
5,809,152 A 9/1998 Nakamura et al.
5,815,582 A 9/1998 Claybaugh et al.
5,832,095 A 11/1998 Daniels
5,852,667 A 12/1998 Pan et al.
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,181,801 B1 1/2001 Puthuff et al.
6,185,300 B1 2/2001 Romesburg
6,219,427 B1 4/2001 Kates et al.
6,275,592 B1 * 8/2001 Vartiainen ..... G10K 11/178 381/71.11
6,278,786 B1 8/2001 McIntosh
6,282,176 B1 8/2001 Hemkumar
6,304,179 B1 10/2001 Lolito et al.
6,317,501 B1 11/2001 Matsuo
6,418,228 B1 * 7/2002 Terai ..... G10K 11/178 381/71.8
6,434,246 B1 8/2002 Kates et al.
6,434,247 B1 8/2002 Kates et al.
6,445,799 B1 9/2002 Taenzer et al.
6,522,746 B1 2/2003 Marchok et al.
6,542,436 B1 4/2003 Myllyla
6,606,382 B2 8/2003 Gupta
6,650,701 B1 11/2003 Hsiang et al.
6,683,960 B1 1/2004 Fujii et al.
6,738,482 B1 5/2004 Jaber
6,766,292 B1 7/2004 Chandran
6,768,795 B2 7/2004 Feltstrom et al.
6,792,107 B2 9/2004 Tucker et al.
6,847,721 B2 1/2005 Zhang et al.
6,850,617 B1 2/2005 Weigand
6,917,688 B2 7/2005 Yu et al.
6,940,982 B1 9/2005 Watkins
6,996,241 B2 2/2006 Ray et al.
7,003,093 B2 2/2006 Prabhu et al.
7,016,504 B1 3/2006 Shennib
7,034,614 B2 4/2006 Robinson et al.
7,058,463 B1 6/2006 Ruha et al.
7,092,514 B2 8/2006 Trump et al.
7,103,188 B1 9/2006 Jones
7,110,864 B2 9/2006 Restrepo et al.
7,142,894 B2 11/2006 Ichikawa et al.
7,162,044 B2 1/2007 Woods
7,177,433 B2 2/2007 Sibbald
7,181,030 B2 2/2007 Rasmussen et al.
7,242,778 B2 7/2007 Csermak et al.
7,317,806 B2 1/2008 Harvey et al.
7,321,913 B2 1/2008 McGrath
7,330,739 B2 2/2008 Somayajula
7,340,064 B2 3/2008 Onishi et al.
7,359,520 B2 4/2008 Brennan et al.
7,365,669 B1 4/2008 Melanson
7,368,918 B2 5/2008 Henson et al.
7,406,179 B2 7/2008 Ryan
7,441,173 B2 10/2008 Restrepo et al.
7,466,838 B1 12/2008 Mosely
7,492,889 B2 2/2009 Ebenezer
7,555,081 B2 6/2009 Keele, Jr.
7,643,641 B2 1/2010 Haulick et al.
7,680,456 B2 3/2010 Muhammad et al.
7,742,746 B2 6/2010 Xiang et al.
7,742,790 B2 6/2010 Konchitsky et al.
7,792,312 B2 9/2010 Inoue et al.
7,817,808 B2 10/2010 Konchitsky et al.
7,885,417 B2 2/2011 Christoph
7,885,420 B2 2/2011 Hetherington et al.
7,895,036 B2 2/2011 Hetherington et al.
7,903,825 B1 3/2011 Melanson
7,925,307 B2 4/2011 Horowitz et al.
7,953,231 B2 5/2011 Ishida
8,014,519 B2 9/2011 Mohammed et al.
8,019,050 B2 9/2011 Mactavish et al.
8,019,103 B2 9/2011 Kates
8,085,966 B2 12/2011 Amsel
8,098,837 B2 1/2012 Inoue et al.
8,107,637 B2 1/2012 Asada et al.
8,111,835 B2 2/2012 Inoue et al.

(56) References Cited

U.S. PATENT DOCUMENTS

| | | | |
|---|---|---|---|
| 8,116,472 | B2 | 2/2012 | Mizuno |
| 8,126,161 | B2 | 2/2012 | Togami et al. |
| 8,135,140 | B2 | 3/2012 | Shridhar et al. |
| 8,144,888 | B2 | 3/2012 | Berkhoff et al. |
| 8,155,330 | B2 | 4/2012 | Chen |
| 8,155,334 | B2 | 4/2012 | Joho et al. |
| 8,165,312 | B2 | 4/2012 | Clemow |
| 8,165,313 | B2 | 4/2012 | Carreras |
| 8,184,816 | B2 | 5/2012 | Ramakrishnan et al. |
| 8,184,822 | B2 | 5/2012 | Carreras et al. |
| 8,189,799 | B2 | 5/2012 | Shridhar et al. |
| 8,194,880 | B2 | 6/2012 | Avendano |
| 8,194,881 | B2 | 6/2012 | Haulick et al. |
| 8,194,882 | B2 | 6/2012 | Every et al. |
| 8,199,923 | B2 | 6/2012 | Christoph |
| 8,218,779 | B2 | 7/2012 | Isberg |
| 8,218,782 | B2 | 7/2012 | Asada et al. |
| 8,229,106 | B2 | 7/2012 | Greiss et al. |
| 8,229,127 | B2 | 7/2012 | Jorgensen et al. |
| D666,169 | S | 8/2012 | Tucker et al. |
| 8,249,262 | B2 | 8/2012 | Chua et al. |
| 8,249,535 | B2 | 8/2012 | Ridgers et al. |
| 8,251,903 | B2 | 8/2012 | LeBoeuf et al. |
| 8,254,589 | B2 | 8/2012 | Mitsuhata |
| 8,270,625 | B2 | 9/2012 | Sommerfeldt et al. |
| 8,280,065 | B2 | 10/2012 | Nadjar et al. |
| 8,285,344 | B2 | 10/2012 | Kahn et al. |
| 8,290,177 | B2 | 10/2012 | Jeong et al. |
| 8,290,537 | B2 | 10/2012 | Lee et al. |
| 8,306,240 | B2 | 11/2012 | Pan et al. |
| 8,311,243 | B2 | 11/2012 | Tucker et al. |
| 8,315,405 | B2 | 11/2012 | Bakalos et al. |
| 8,320,591 | B1 | 11/2012 | Wurtz |
| 8,325,934 | B2 | 12/2012 | Kuo |
| 8,331,604 | B2 | 12/2012 | Saito et al. |
| 8,345,888 | B2 | 1/2013 | Carreras et al. |
| 8,345,890 | B2 | 1/2013 | Avendano et al. |
| 8,355,512 | B2 | 1/2013 | Pan et al. |
| 8,374,358 | B2 | 2/2013 | Buck et al. |
| 8,374,362 | B2 | 2/2013 | Ramakrishnan et al. |
| 8,379,884 | B2 | 2/2013 | Horibe et al. |
| 8,385,559 | B2 | 2/2013 | Theverapperuma et al. |
| 8,385,560 | B2 | 2/2013 | Solbeck et al. |
| 8,401,200 | B2 | 3/2013 | Tiscareno et al. |
| 8,401,204 | B2 | 3/2013 | Odent et al. |
| 8,428,274 | B2 | 4/2013 | Shiraishi et al. |
| 8,442,251 | B2 | 5/2013 | Jensen et al. |
| 8,472,682 | B2 | 6/2013 | Guissin et al. |
| 8,498,589 | B2 | 7/2013 | Husted et al. |
| 8,515,089 | B2 | 8/2013 | Nicholson |
| 8,526,627 | B2 | 9/2013 | Asao et al. |
| 8,526,628 | B1 | 9/2013 | Massie et al. |
| 8,532,310 | B2 | 9/2013 | Gauger, Jr. et al. |
| 8,539,012 | B2 | 9/2013 | Clark |
| 8,548,176 | B2 | 10/2013 | Bright |
| 8,554,556 | B2 | 10/2013 | Yu |
| 8,559,648 | B2 | 10/2013 | Christoph |
| 8,559,661 | B2 | 10/2013 | Tanghe |
| 8,600,085 | B2 | 12/2013 | Chen et al. |
| 8,644,521 | B2 | 2/2014 | Christoph et al. |
| 8,681,999 | B2 | 3/2014 | Theverapperuma et al. |
| 8,682,250 | B2 | 3/2014 | Magrath et al. |
| 8,693,699 | B2 | 4/2014 | Fellers et al. |
| 8,693,700 | B2 | 4/2014 | Bakalos et al. |
| 8,693,701 | B2 | 4/2014 | Scarlett et al. |
| 8,706,482 | B2 | 4/2014 | Konchitsky |
| 8,718,291 | B2 | 5/2014 | Alves et al. |
| 8,737,633 | B2 | 5/2014 | Sibbald et al. |
| 8,737,636 | B2 | 5/2014 | Park et al. |
| 8,744,100 | B2 | 6/2014 | Kojima |
| 8,744,844 | B2 | 6/2014 | Klein |
| 8,750,531 | B2 | 6/2014 | Delano et al. |
| 8,774,952 | B2 | 7/2014 | Kim et al. |
| 8,775,172 | B2 | 7/2014 | Konchitsky et al. |
| 8,804,974 | B1 | 8/2014 | Melanson |
| 8,831,239 | B2 | 9/2014 | Bakalos |
| 8,842,848 | B2 | 9/2014 | Donaldson et al. |
| 8,848,936 | B2 | 9/2014 | Kwatra et al. |
| 8,855,330 | B2 | 10/2014 | Taenzer |
| 8,903,101 | B2 | 12/2014 | Christoph et al. |
| 8,907,829 | B1 | 12/2014 | Naderi |
| 8,908,877 | B2 | 12/2014 | Abdollahzadeh Milani et al. |
| 8,909,524 | B2 | 12/2014 | Stoltz et al. |
| 8,942,387 | B2 | 1/2015 | Elko et al. |
| 8,942,976 | B2 | 1/2015 | Li et al. |
| 8,948,407 | B2 | 2/2015 | Alderson et al. |
| 8,948,410 | B2 | 2/2015 | Van Leest |
| 8,953,813 | B2 | 2/2015 | Loeda |
| 8,958,571 | B2 | 2/2015 | Kwatra et al. |
| 8,977,545 | B2 | 3/2015 | Zeng et al. |
| 9,014,387 | B2 | 4/2015 | Hendrix et al. |
| 9,020,065 | B2 | 4/2015 | Wyville |
| 9,020,158 | B2 | 4/2015 | Wertz et al. |
| 9,020,160 | B2 | 4/2015 | Gauger, Jr. |
| 9,031,251 | B2 | 5/2015 | Alcock |
| 9,037,458 | B2 | 5/2015 | Park et al. |
| 9,053,697 | B2 | 6/2015 | Park et al. |
| 9,055,367 | B2 | 6/2015 | Li et al. |
| 9,058,801 | B2 | 6/2015 | Po et al. |
| 9,066,176 | B2 | 6/2015 | Hendrix et al. |
| 9,071,724 | B2 | 6/2015 | Do et al. |
| 9,076,427 | B2 | 7/2015 | Alderson et al. |
| 9,076,431 | B2 | 7/2015 | Kamath et al. |
| 9,082,387 | B2 | 7/2015 | Hendrix et al. |
| 9,082,391 | B2 | 7/2015 | Yermeche et al. |
| 9,094,744 | B1 | 7/2015 | Lu et al. |
| 9,099,077 | B2 | 8/2015 | Nicholson et al. |
| 9,106,989 | B2 | 8/2015 | Li et al. |
| 9,107,010 | B2 | 8/2015 | Abdollahzadeh Milani et al. |
| 9,113,243 | B2 | 8/2015 | Nielsen et al. |
| 9,123,321 | B2 | 9/2015 | Alderson et al. |
| 9,123,325 | B2 | 9/2015 | Iseki et al. |
| 9,129,586 | B2 | 9/2015 | Bajic et al. |
| 9,131,294 | B2 | 9/2015 | Bright |
| 9,135,907 | B2 | 9/2015 | Fellers et al. |
| 9,142,205 | B2 | 9/2015 | Alderson et al. |
| 9,142,207 | B2 | 9/2015 | Hendrix et al. |
| 9,142,221 | B2 | 9/2015 | Sun et al. |
| 9,153,226 | B2 | 10/2015 | Wurm |
| 9,202,455 | B2 | 12/2015 | Park et al. |
| 9,202,456 | B2 | 12/2015 | Lee et al. |
| 9,203,366 | B2 | 12/2015 | Eastty |
| 9,204,232 | B2 | 12/2015 | Klemmensen |
| 9,208,769 | B2 | 12/2015 | Azmi |
| 9,208,771 | B2 | 12/2015 | Zhou et al. |
| 9,214,150 | B2 | 12/2015 | Kwatra |
| 9,226,066 | B2 | 12/2015 | Ohta et al. |
| 9,226,068 | B2 | 12/2015 | Hendrix et al. |
| 9,230,532 | B1 | 1/2016 | Lu et al. |
| 9,253,560 | B2 | 2/2016 | Goldstein et al. |
| 9,264,808 | B2 | 2/2016 | Zhou et al. |
| 9,291,697 | B2 | 3/2016 | Kim et al. |
| 9,294,836 | B2 | 3/2016 | Zhou et al. |
| 9,301,049 | B2 | 3/2016 | Elko et al. |
| 9,318,090 | B2 | 4/2016 | Zhou et al. |
| 9,318,094 | B2 | 4/2016 | Hendrix et al. |
| 9,319,781 | B2 | 4/2016 | Alderson et al. |
| 9,319,784 | B2 | 4/2016 | Lu et al. |
| 9,324,311 | B1 | 4/2016 | Abdollahzadeh Milani et al. |
| 9,325,821 | B1 | 4/2016 | Hendrix et al. |
| 9,330,653 | B2 | 5/2016 | Yokota |
| 9,344,792 | B2 | 5/2016 | Rundle |
| 9,351,085 | B2 | 5/2016 | Hojlund et al. |
| 9,368,099 | B2 | 6/2016 | Alderson et al. |
| 9,369,557 | B2 | 6/2016 | Kaller et al. |
| 9,369,798 | B1 | 6/2016 | Alderson et al. |
| 9,392,364 | B1 | 7/2016 | Milani et al. |
| 9,402,124 | B2 | 7/2016 | Zhang |
| 9,414,150 | B2 | 8/2016 | Hendrix et al. |
| 9,437,182 | B2 | 9/2016 | Doclo |
| 9,445,172 | B2 | 9/2016 | Pong et al. |
| 9,460,701 | B2 | 10/2016 | Yong et al. |
| 9,462,376 | B2 | 10/2016 | Alderson |
| 9,478,210 | B2 | 10/2016 | Hellman |

(56) References Cited

U.S. PATENT DOCUMENTS

| | | | |
|---|---|---|---|
| 9,478,212 | B1 | 10/2016 | Sorensen et al. |
| 9,479,860 | B2 | 10/2016 | Kwatra et al. |
| 9,485,569 | B2 | 11/2016 | Kitazawa et al. |
| 9,502,020 | B1 | 11/2016 | Abdollahzadeh Milani et al. |
| 9,515,629 | B2 | 12/2016 | Goldstein et al. |
| 9,516,407 | B2 | 12/2016 | Goldstein et al. |
| 9,532,139 | B1 | 12/2016 | Lu et al. |
| 9,538,285 | B2 | 1/2017 | Rayala et al. |
| 9,538,286 | B2 | 1/2017 | Samuelsson |
| 9,565,490 | B2 | 2/2017 | Hyatt |
| 9,578,415 | B1 | 2/2017 | Zhou et al. |
| 9,633,646 | B2 | 4/2017 | Hendrix et al. |
| 9,646,595 | B2 | 5/2017 | Abdollahzadeh Milani et al. |
| 9,648,409 | B2 | 5/2017 | Puskarich |
| 9,704,472 | B2 | 7/2017 | Kwatra |
| 2001/0053228 | A1 | 12/2001 | Jones |
| 2004/0017921 | A1 | 1/2004 | Mantovani |
| 2005/0018862 | A1 | 1/2005 | Fisher |
| 2005/0117754 | A1 | 6/2005 | Sakawaki |
| 2006/0013408 | A1 | 1/2006 | Lee |
| 2006/0018460 | A1 | 1/2006 | McCree |
| 2006/0035593 | A1 | 2/2006 | Leeds |
| 2006/0055910 | A1 | 3/2006 | Lee |
| 2006/0153400 | A1 | 7/2006 | Fujita et al. |
| 2006/0159282 | A1 | 7/2006 | Borsch |
| 2006/0161428 | A1 | 7/2006 | Fouret |
| 2006/0251266 | A1 | 11/2006 | Saunders et al. |
| 2007/0033029 | A1 | 2/2007 | Sakawaki |
| 2007/0047742 | A1 | 3/2007 | Taenzer et al. |
| 2007/0076896 | A1 | 4/2007 | Hosaka et al. |
| 2007/0208520 | A1 | 9/2007 | Zhang et al. |
| 2007/0258597 | A1 | 11/2007 | Rasmussen et al. |
| 2007/0297620 | A1 | 12/2007 | Choy |
| 2008/0063228 | A1* | 3/2008 | Mejia ..... H04R 25/502 381/318 |
| 2008/0181422 | A1* | 7/2008 | Christoph ..... G10K 11/17817 381/73.1 |
| 2009/0034748 | A1 | 2/2009 | Sibbald |
| 2009/0086990 | A1* | 4/2009 | Christoph ..... H04R 3/04 381/71.12 |
| 2009/0175461 | A1 | 7/2009 | Nakamura et al. |
| 2010/0014683 | A1* | 1/2010 | Maeda ..... G10K 11/178 381/71.4 |
| 2010/0014685 | A1 | 1/2010 | Wurm |
| 2010/0061564 | A1 | 3/2010 | Clemow et al. |
| 2010/0082339 | A1 | 4/2010 | Konchitsky et al. |
| 2010/0124335 | A1 | 5/2010 | Wessling et al. |
| 2010/0166203 | A1 | 7/2010 | Peissig et al. |
| 2010/0166206 | A1 | 7/2010 | Macours |
| 2010/0226210 | A1 | 9/2010 | Kordis et al. |
| 2010/0239126 | A1 | 9/2010 | Grafenberg et al. |
| 2010/0284546 | A1 | 11/2010 | DeBrunner et al. |
| 2010/0296666 | A1 | 11/2010 | Lin |
| 2010/0310086 | A1 | 12/2010 | Magrath et al. |
| 2011/0091047 | A1 | 4/2011 | Konchitsky et al. |
| 2011/0099010 | A1 | 4/2011 | Zhang |
| 2011/0116654 | A1 | 5/2011 | Chan et al. |
| 2011/0288860 | A1 | 11/2011 | Schevciw et al. |
| 2011/0317848 | A1 | 12/2011 | Ivanov et al. |
| 2012/0135787 | A1 | 5/2012 | Kusunoki et al. |
| 2012/0155666 | A1 | 6/2012 | Nair |
| 2012/0179458 | A1 | 7/2012 | Oh et al. |
| 2012/0263317 | A1 | 10/2012 | Shin et al. |
| 2012/0300960 | A1 | 11/2012 | Mackay et al. |
| 2012/0308028 | A1 | 12/2012 | Kwatra et al. |
| 2013/0156238 | A1 | 6/2013 | Birch et al. |
| 2013/0243198 | A1 | 9/2013 | Van Rumpt |
| 2014/0086425 | A1 | 3/2014 | Jensen et al. |
| 2014/0294182 | A1 | 10/2014 | Axelsson et al. |
| 2014/0307888 | A1 | 10/2014 | Alderson et al. |
| 2015/0104032 | A1 | 4/2015 | Kwatra et al. |
| 2015/0161980 | A1 | 6/2015 | Alderson et al. |
| 2015/0163592 | A1 | 6/2015 | Alderson |
| 2015/0195646 | A1 | 7/2015 | Kumar et al. |
| 2015/0269926 | A1 | 9/2015 | Alderson et al. |
| 2015/0365761 | A1 | 12/2015 | Alderson et al. |
| 2016/0196816 | A1 | 7/2016 | Zhou et al. |
| 2016/0232887 | A1 | 8/2016 | Hendrix et al. |
| 2016/0316291 | A1 | 10/2016 | Hendrix et al. |
| 2017/0053639 | A1 | 2/2017 | Lu et al. |

FOREIGN PATENT DOCUMENTS

| | | | | |
|---|---|---|---|---|
| EP | 0412902 | A2 | 2/1991 | |
| EP | 0756407 | A2 * | 1/1997 | ..... H04M 1/19 |
| EP | 0898266 | A2 * | 2/1999 | ..... G10K 11/178 |
| EP | 1691577 | A2 | 8/2006 | |
| EP | 1880699 | A2 | 1/2008 | |
| EP | 1921603 | A2 | 5/2008 | |
| EP | 1947642 | A1 | 7/2008 | |
| EP | 2133866 | A1 | 12/2009 | |
| EP | 2216774 | A1 * | 8/2010 | ..... G10K 11/178 |
| EP | 2216774 | A1 | 8/2010 | |
| EP | 2237573 | A1 | 10/2010 | |
| EP | 2259250 | A1 | 12/2010 | |
| EP | 2395500 | A1 | 12/2011 | |
| EP | 2395501 | A1 | 12/2011 | |
| EP | 2551845 | A1 | 1/2013 | |
| GB | 2401744 | A | 11/2004 | |
| GB | 2436657 | A | 10/2007 | |
| GB | 2455821 | A | 6/2009 | |
| GB | 2455824 | A | 6/2009 | |
| GB | 2455828 | A | 6/2009 | |
| GB | 2484722 | A | 4/2012 | |
| GB | 2539280 | A | 12/2016 | |
| JP | 52071502 | | 5/1977 | |
| JP | 03162099 | | 7/1991 | |
| JP | H05-022391 | | 1/1993 | |
| JP | H05265468 | | 10/1993 | |
| JP | 05341792 | | 12/1993 | |
| JP | 06006246 | | 1/1994 | |
| JP | H06-186985 | A | 7/1994 | |
| JP | H06232755 | | 8/1994 | |
| JP | 07098592 | | 4/1995 | |
| JP | 07104769 | | 4/1995 | |
| JP | H017106886 | A | 4/1995 | |
| JP | 07240989 | | 9/1995 | |
| JP | 07325588 | | 12/1995 | |
| JP | H07334169 | | 12/1995 | |
| JP | H08227322 | | 9/1996 | |
| JP | H10247088 | | 9/1998 | |
| JP | H10257159 | | 9/1998 | |
| JP | 10294989 | | 11/1998 | |
| JP | H11305783 | A | 11/1999 | |
| JP | 2000089770 | | 3/2000 | |
| JP | 2002010355 | | 1/2002 | |
| JP | 2004007107 | | 1/2004 | |
| JP | 2006217542 | A | 8/2006 | |
| JP | 2007003994 | | 1/2007 | |
| JP | 2007060644 | | 3/2007 | |
| JP | 2007175486 | | 7/2007 | |
| JP | 2008015046 | A | 1/2008 | |
| JP | WO 2009041012 | A1 * | 4/2009 | ..... G10K 11/178 |
| JP | 2010277025 | | 12/2010 | |
| JP | 2011055494 | | 3/2011 | |
| JP | 2011061449 | | 3/2011 | |
| WO | WO 199113429 | | 9/1991 | |
| WO | WO 1993004529 | | 3/1993 | |
| WO | WO 1994007212 | | 3/1994 | |
| WO | WO 1999011045 | | 3/1999 | |
| WO | WO 2003015074 | A1 | 2/2003 | |
| WO | WO 2003015275 | A1 | 2/2003 | |
| WO | WO 2004009007 | A1 | 1/2004 | |
| WO | WO 2004017303 | A1 | 2/2004 | |
| WO | WO 2006125061 | A1 | 11/2006 | |
| WO | WO 2006128768 | A1 | 12/2006 | |
| WO | WO 2007007916 | A1 | 1/2007 | |
| WO | WO 2007011337 | | 1/2007 | |
| WO | WO 2007110807 | A2 | 10/2007 | |
| WO | WO 2007113487 | A1 | 11/2007 | |
| WO | WO 2009041012 | A1 | 4/2009 | |
| WO | WO 2009110087 | A1 | 9/2009 | |
| WO | WO 2009155696 | A1 | 12/2009 | |
| WO | WO 2010117714 | A1 | 10/2010 | |

(56) References Cited

FOREIGN PATENT DOCUMENTS

| | | | |
|---|---|---|---|
| WO | WO 2010131154 | A1 | 11/2010 |
| WO | WO 2012134874 | A1 | 10/2012 |
| WO | WO-2013106370 | A1 | 7/2013 |
| WO | WO 2015038255 | A1 | 3/2015 |
| WO | WO 2015088639 | A1 | 6/2015 |
| WO | WO 2015088651 | A1 | 6/2015 |
| WO | WO 2016054186 | A1 | 4/2016 |
| WO | WO-2016100602 | A1 | 6/2016 |

OTHER PUBLICATIONS

Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.

Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.

Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.

Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.

Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.

Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.

Davari, et al., "A New Online Secondary Path Modeling Method for Feedforward Active Noise Control Systems," IEEE International Conference on Industrial Technology, Apr. 21-24, 2008, pp. 1-6, Chengdu, China.

Erkelens, et al., "Tracking of Nonstationary Noise Based on Data-Driven Recursive Noise Power Estimation", IEEE Transactions on Audio Speech and Language Processing, Aug. 2008, pp. 1112-1123, vol. 16, No. 6, Piscataway, NJ, US.

Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.

Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.

Goeckler, H.G. et al., "Efficient Multirate Digital Filters Based on Fractional Polyphase Decomposition for Subnyquist Processing", Proceedings of the European Conference on Circuit Theory & Design, vol. 1, Jan. 1, 1999, pp. 409-412.

Hurst, et al., "An improved double sampling scheme for switched-capacitor delta-sigma modulators", 1992 IEEE Int. Symp. on Circuits and Systems, May 10-13, 1992, vol. 3, pp. 1179-1182, San Diego, CA.

Jin, et al. "A simultaneous equation method-based online secondary path modeling algorithm for active noise control", Journal of Sound and Vibration, Apr. 25, 2007, pp. 455-474, vol. 303, No. 3-5, London, GB.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Kates, James M., "Principles of Digital Dynamic Range Compression," Trends in Amplification, Spring 2005, pp. 45-76, vol. 9, No. 2, Sage Publications.

Kuo, et al., "Residual noise shaping technique for active noise control systems", J. Acoust. Soc. Am. 95 (3), Mar. 1994, pp. 1665-1668.

Kuo, et al., "Active Noise Control: A Tutorial Review," Proceedings of the IEEE, Jun. 1999, pp. 943-973, vol. 87, No. 6, IEEE Press, Piscataway, NJ.

Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.

Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.

Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.

Liu, et al., "Compensatory Responses to Loudness-shifted Voice Feedback During Production of Mandarin Speech", Journal of the Acoustical Society of America, Oct. 2007, pp. 2405-2412, vol. 122, No. 4.

Lopez-Caudana, Edgar Omar, "Active Noise Cancellation: The Unwanted Signal and The Hybrid Solution", Adaptive Filtering Applications, Dr. Lino Garcia (Ed.), Jul. 2011, pp. 49-84, ISBN: 978-953-307-306-4, InTech.

Lopez-Caudana, et al., "A Hybrid Noise Cancelling Algorithm with Secondary Path Estimation", WSEAS Transactions on Signal Processing, vol. 4, No. 12, Dec. 2008, pp. 677-687, Mexico.

Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.

Mali, Dilip, "Comparison of DC Offset Effects on LMS Algorithm and its Derivatives," International Journal of Recent Trends in Engineering, May 2009, pp. 323-328, vol. 1, No. 1, Academy Publisher.

Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.

Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.

Morgan, et al., A Delayless Subband Adaptive Filter Architecture, IEEE Transactions on Signal Processing, IEEE Service Center, Aug. 1995, pp. 1819-1829, vol. 43, No. 8, New York, NY, US.

Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.

Parkins, et al., "Narrowband and broadband active control in an enclosure using the acoustic energy density", J. Acoust. Soc. Am. Jul. 2000, pp. 192-203, vol. 108, issue 1, US.

Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.

Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.

Rafaely, Boaz, "Active Noise Reducing Headset—an Overview", The 2001 International Congress and Exhibition on Noise Control Engineering, Aug. 27-30, 2001, 10 pages (pp. 1-10 in pdf), The Netherlands.

Rangachari, et al., "A noise-estimation algorithm for highly non-stationary environments", Speech Communication, Feb. 2006, pp. 220-231, vol. 48, No. 2. Elsevier Science Publishers.

Rao, et al., "A Novel Two State Single Channel Speech Enhancement Technique", India Conference (INDICON) 2011 Annual IEEE, IEEE, Dec. 2011, 6 pages (pp. 1-6 in pdf), Piscataway, NJ, US.

(56) References Cited

OTHER PUBLICATIONS

Ray, et al., "Hybrid Feedforward-Feedback Active Noise Reduction for Hearing Protection and Communication", The Journal of the Acoustical Society of America, American Institute of Physics for the Acoustical Society of America, Jan. 2006, pp. 2026-2036, vol. 120, No. 4, New York, NY.
Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt. 1, Ottawa, Ontario, Canada.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Toochinda, et al. "A Single-Input Two-Output Feedback Formulation for ANC Problems," Proceedings of the 2001 American Control Conference, Jun. 2001, pp. 923-928, vol. 2, Arlington, VA.
Widrow, B., et al., Adaptive Noise Cancelling; Principles and Applications, Proceedings of the IEEE, Dec. 1975, pp. 1692-1716, vol. 63, No. 13, IEEE, New York, NY, US.
Wu, et al., "Decoupling feedforward and feedback structures in hybrid active noise control systems for uncorrelated narrowband disturbances", Journal of Sound and Vibration, vol. 350, Aug. 18, 2015, pp. 1-10, Elsevier.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Notice of Allowance in U.S. Appl. No. 13/472,755, dated Jul. 12, 2017, 14 pages (pp. 1-14 in pdf).
Notice of Allowance in U.S. Appl. No. 13/472,755, dated Oct. 14, 2016, 18 pages (pp. 1-18 in pdf).
Final Office Action in U.S. Appl. No. 13/472,755, dated Aug. 18, 2015, 25 pages (pp. 1-25 in pdf).
Office Action in U.S. Appl. No. 13/472,755, dated Jan. 2, 2015, 30 pages (pp. 1-30 in pdf).
International Search Report and Written Opinion in PCT/US2012/039314, dated Apr. 4, 2013, 13 pages (pp. 1-13 in pdf).
Written Opinion of the International Preliminary Examining Authority in PCT/US2012/039314, dated Sep. 26, 2013, 6 pages (pp. 1-6 in pdf).
International Preliminary Report on Patentability in PCT/US2012/039314, dated Jan. 9, 2014, 23 pages (pp. 1-23 in pdf).

* cited by examiner

BANDLIMITING ANTI-NOISE IN PERSONAL AUDIO DEVICES HAVING ADAPTIVE NOISE CANCELLATION (ANC)

This U.S. patent application is a Continuation of U.S. patent application Ser. No. 13/472,755 filed on May 16, 2012 and published as U.S. Patent Publication Ser. No. 20120308028 on Dec. 6, 2012, and claims priority thereto under 35 U.S.C. § 120. U.S. patent application Ser. No. 13/472,755 claims priority under 35 U.S.C. § 119(e) to U.S. Provisional Patent Application Ser. No. 61/493,162 filed on Jun. 3, 2011.

BACKGROUND OF THE INVENTION

1. Field of the Invention

The present invention relates generally to personal audio devices such as wireless telephones that include noise cancellation, and more specifically, to a personal audio device in which the anti-noise signal is biased by filtering one or more of the adaptation inputs.

2. Background of the Invention

Wireless telephones, such as mobile/cellular telephones, cordless telephones, and other consumer audio devices, such as MP3 players and headphones or earbuds, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

The anti-noise signal can be generated using an adaptive filter that takes into account changes in the acoustic environment. However, adaptive noise canceling may cause an increase in apparent noise at certain frequencies due to the adaptive filter acting to decrease the amplitude of noise or other acoustic events at other frequencies, which may result in undesired behavior in a personal audio device.

Therefore, it would be desirable to provide a personal audio device, including a wireless telephone, that provides noise cancellation in a variable acoustic environment that can avoid problems associated with increasing apparent noise in some frequency bands while reducing apparent noise in others.

SUMMARY OF THE INVENTION

The above stated objective of providing a personal audio device providing noise cancellation in a variable acoustic environment, is accomplished in a personal audio device, a method of operation, and an integrated circuit. The method is a method of operation of the personal audio device and the integrated circuit, which can be incorporated within the personal audio device.

The personal audio device includes a housing, with a transducer mounted on the housing for reproducing an audio signal that includes both source audio for playback to a listener and an anti-noise signal for countering the effects of ambient audio sounds in an acoustic output of the transducer. A reference microphone is mounted on the housing to provide a reference microphone signal indicative of the ambient audio sounds. The personal audio device further includes an adaptive noise-canceling (ANC) processing circuit within the housing for adaptively generating an anti-noise signal from the reference microphone signal. An error microphone is included for controlling the adaptation of the anti-noise signal to cancel the ambient audio sounds and for correcting for the electro-acoustic path from the output of the processing circuit through the transducer. The anti-noise signal is generated such that the ambient audio sounds are minimized at the error microphone. One or both of the reference microphone and/or error microphone signals are filtered to weight one or more frequency regions in order to alter a degree of the minimization of the ambient audio sounds in the one or more frequency regions.

The foregoing and other objectives, features, and advantages of the invention will be apparent from the following, more particular, description of the preferred embodiment of the invention, as illustrated in the accompanying drawings.

DESCRIPTION OF ILLUSTRATIVE EMBODIMENT

The present invention encompasses noise canceling techniques and circuits that can be implemented in a personal audio device, such as a wireless telephone. The personal audio device includes an adaptive noise canceling (ANC) circuit that measures the ambient acoustic environment and generates an adaptive anti-noise signal that is injected in the speaker (or other transducer) output to cancel ambient acoustic events. A reference microphone is provided to measure the ambient acoustic environment and an error microphone is included to control adaptation of the anti-noise signal to cancel the ambient acoustic events and to provide estimation of an electro-acoustical path from the output of the ANC circuit through the speaker. An adaptive filter minimizes the ambient acoustic events at the error microphone signal by generating the anti-noise signal from the reference microphone signal using an adaptive filter. The coefficient control inputs of the adaptive filter are provided by the reference microphone signal and the error microphone signal. The ANC processing circuit avoids boosting particular frequencies of the reference microphone signal, thereby increasing noise at those frequencies, by filtering one or both of the reference microphone and error microphone signal provided to the coefficient control inputs of the adaptive filter, in order to alter the minimization of the ambient acoustic events at the error microphone signal. By altering the minimization, boosting of the particular frequencies can be prevented.

Figure 1:
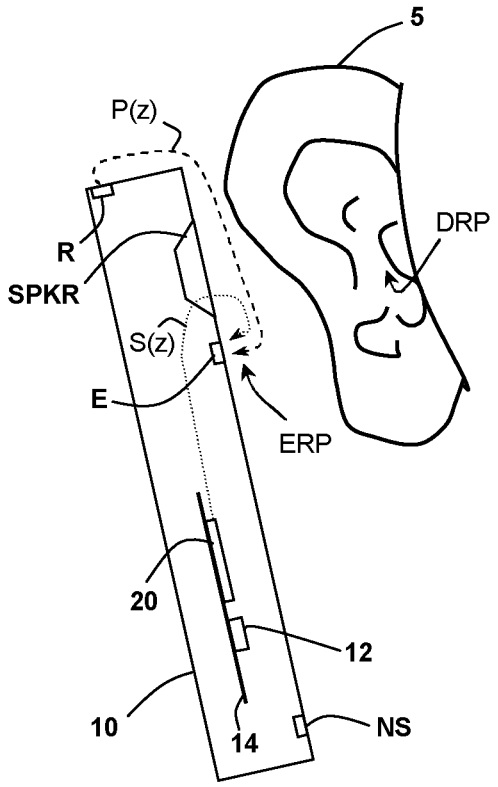
FIG. 1 is an illustration of a wireless telephone 10 in accordance with an embodiment of the present invention.

Referring now to FIG. 1, a wireless telephone 10 is illustrated in accordance with an embodiment of the present invention is shown in proximity to a human ear 5. Illustrated wireless telephone 10 is an example of a device in which techniques in accordance with embodiments of the invention may be employed, but it is understood that not all of the elements or configurations embodied in illustrated wireless telephone 10, or in the circuits depicted in subsequent illustrations, are required in order to practice the invention recited in the Claims. Wireless telephone 10 includes a transducer such as speaker SPKR that reproduces distant speech received by wireless telephone 10, along with other local audio event such as ringtones, stored audio program material, injection of near-end speech (i.e., the speech of the user of wireless telephone 10) to provide a balanced conversational perception, and other audio that requires reproduction by wireless telephone 10, such as sources from web-pages or other network communications received by wireless telephone 10 and audio indications such as battery low and other system event notifications. A near-speech microphone NS is provided to capture near-end speech, which is transmitted from wireless telephone 10 to the other conversation participant(s).

Wireless telephone 10 includes adaptive noise canceling (ANC) circuits and features that inject an anti-noise signal into speaker SPKR to improve intelligibility of the distant speech and other audio reproduced by speaker SPKR. A reference microphone R is provided for measuring the ambient acoustic environment, and is positioned away from the typical position of a user's mouth, so that the near-end speech is minimized in the signal produced by reference microphone R. A third microphone, error microphone E, is provided in order to further improve the ANC operation by providing a measure of the ambient audio combined with the audio reproduced by speaker SPKR close to ear 5 at an error microphone reference position ERP, when wireless telephone 10 is in close proximity to ear 5. Exemplary circuits 14 within wireless telephone 10 include an audio CODEC integrated circuit 20 that receives the signals from reference microphone R, near speech microphone NS, and from error microphone E. Audio CODEC integrated circuit 20 interfaces with other integrated circuits such as an RF integrated circuit 12 containing the wireless telephone transceiver. In other embodiments of the invention, the circuits and techniques disclosed herein may be incorporated in a single integrated circuit that contains control circuits and other functionality for implementing the entirety of the personal audio device, such as an MP3 player-on-a-chip integrated circuit.

In general, the ANC techniques of the present invention measure ambient acoustic events (as opposed to the output of speaker SPKR and/or the near-end speech) impinging on reference microphone R, and also by measuring the same ambient acoustic events impinging on error microphone E. The ANC processing circuits of illustrated wireless telephone 10 adapt an anti-noise signal generated from the output of reference microphone R to have a characteristic that minimizes the amplitude of the ambient acoustic events at error microphone E, i.e. at error microphone reference position ERP. Since acoustic path P(z) extends from reference microphone R to error microphone E, the ANC circuits are essentially estimating acoustic path P(z) combined with removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which is affected by the proximity and structure of ear 5 and other physical objects and human head structures that may be in proximity to wireless telephone 10, when wireless telephone is not firmly pressed to ear 5. Since the user of wireless telephone 10 actually hears the output of speaker SPKR at a drum reference position DRP, differences between the signal produced by error microphone E and what is actually heard by the user are shaped by the response of the ear canal, as well as the spatial distance between error microphone reference position ERP and drum reference position DRP. At higher frequencies, the spatial differences lead to multi-path nulls that reduce the effectiveness of the ANC system, and in some cases may increase ambient noise. While the illustrated wireless telephone 10 includes a two microphone ANC system with a third near speech microphone NS, some aspects of the present invention may be practiced in a system that does not include separate error and reference microphones, or a wireless telephone uses near speech microphone NS to perform the function of the reference microphone R. Also, in personal audio devices designed only for audio playback, near speech microphone NS will generally not be included, and the near-speech signal paths in the circuits described in further detail below can be omitted, without changing the scope of the invention.

Figure 2:
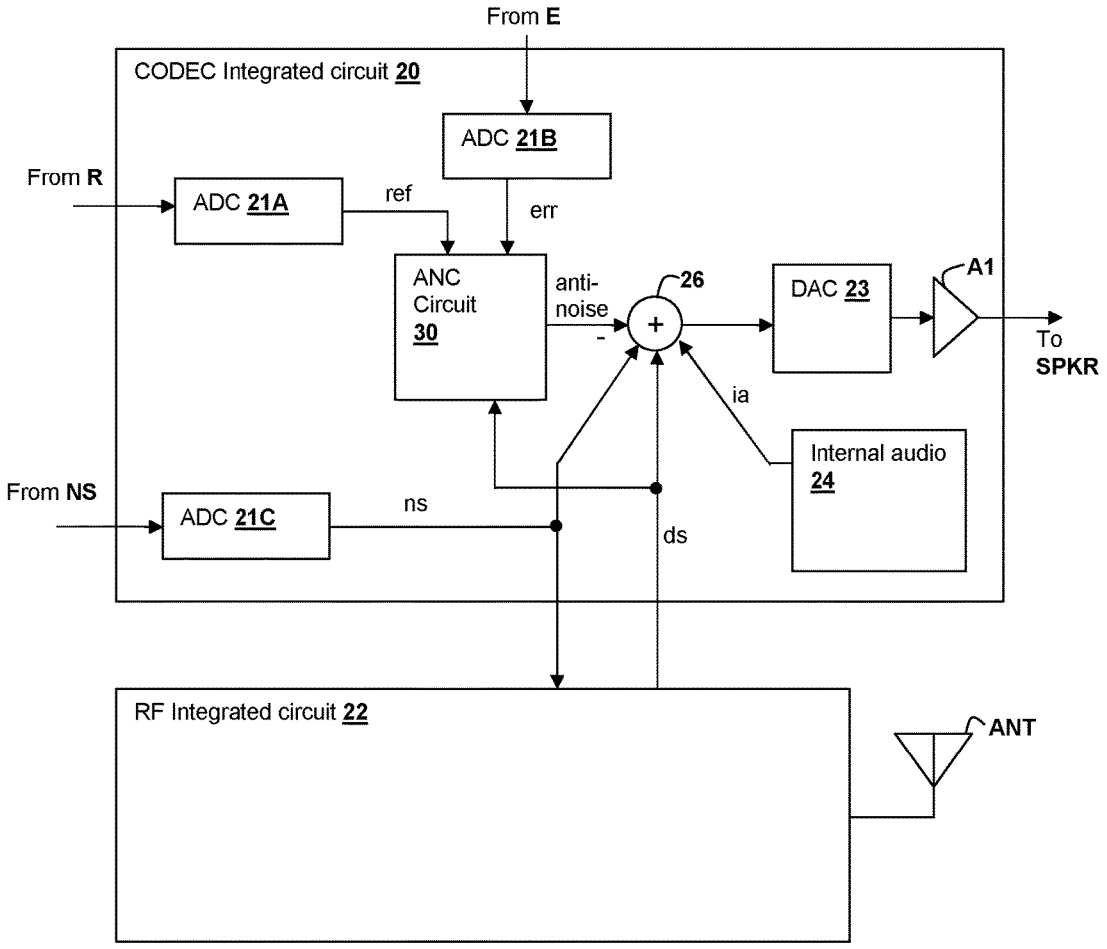
FIG. 2 is a block diagram of circuits within wireless telephone 10 in accordance with an embodiment of the present invention.

Referring now to FIG. 2, circuits within wireless telephone 10 are shown in a block diagram. CODEC integrated circuit (IC) 20 includes an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 generates an output for driving speaker SPKR from an amplifier A1, which amplifies the output of a digital-to-analog converter (DAC) 23 that receives the output of a combiner 26. Combiner 26 combines audio signals ia from internal audio sources 24, the anti-noise signal generated by ANC circuit 30, which by convention has the same polarity as the noise in reference microphone signal ref and is therefore subtracted by combiner 26, a portion of near speech microphone signal ns so that the user of wireless telephone 10 hears their own voice in proper relation to downlink speech ds, which is received from radio frequency (RF) integrated circuit 22 and is also combined by combiner 26. Near speech microphone signal ns is also provided to RF integrated circuit 22 and is transmitted as uplink speech to the service provider via antenna ANT.

Figure 3:
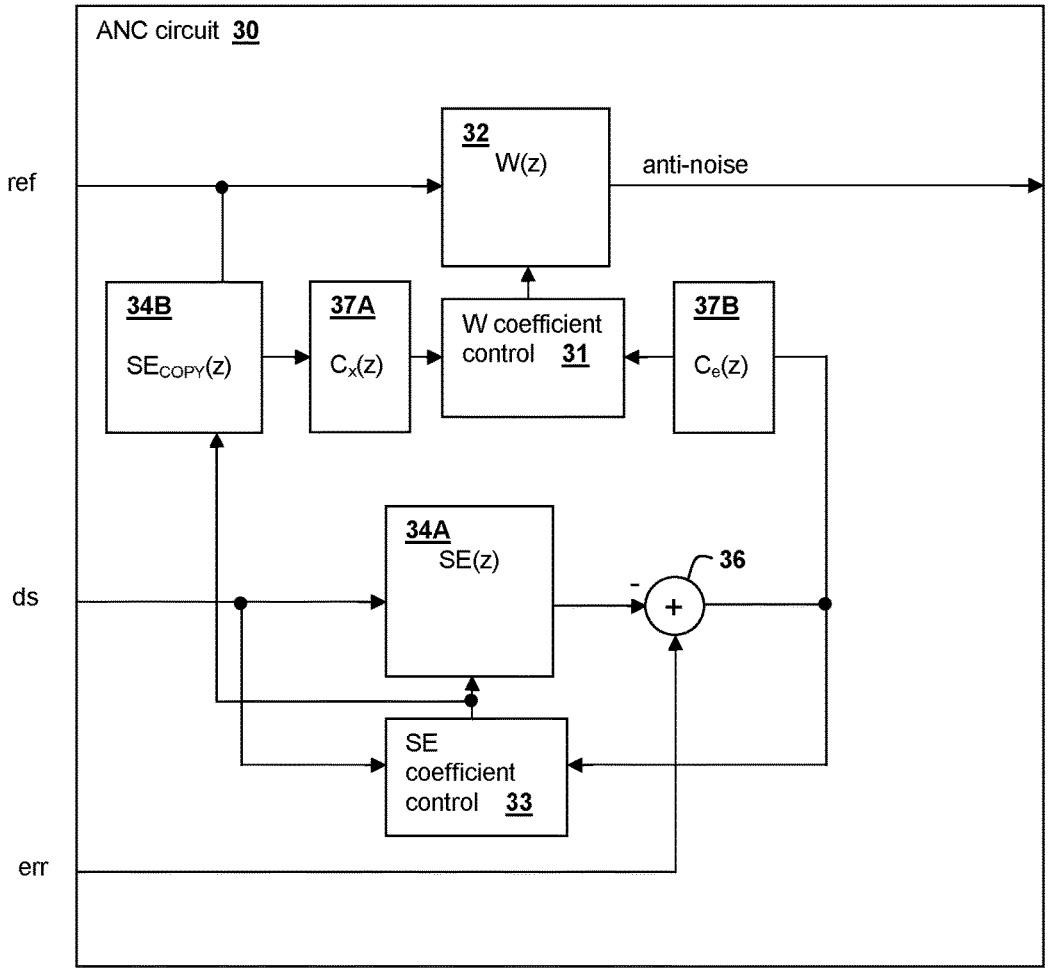
FIG. 3 is a block diagram depicting signal processing circuits and functional blocks within ANC circuit 30 of CODEC integrated circuit 20 of FIG. 2 in accordance with an embodiment of the present invention.

Referring now to FIG. 3, details of an ANC circuit 30 of FIG. 2 are shown in accordance with an embodiment of the present invention. Adaptive filter 32 receives reference microphone signal ref and under ideal circumstances, adapts its transfer function W(z) to be P(z)/S(z) to generate the anti-noise signal. The coefficients of adaptive filter 32 are controlled by a W coefficient control block 31 that uses a correlation of two signals to determine the response of adaptive filter 32, which generally minimizes, in a least-mean squares sense, those components of reference microphone signal ref that are present in error microphone signal err. The signals provided as inputs to W coefficient control block 31 are the reference microphone signal ref as shaped by a copy of an estimate of the response of path S(z) provided by filter 34B and another signal provided from the output of a combiner 36 that includes error microphone signal err. By transforming reference microphone signal ref with a copy of the estimate of the response of path S(z), $SE_{COPY}(z)$, and minimizing the portion of the error signal that correlates with components of reference microphone signal ref, adaptive filter 32 adapts to the desired response of P(z)/S(z). A filter 37A that has a response $C_x(z)$ as explained in further detail below, processes the output of filter 34B and provides the first input to W coefficient control block 31. The second input to W coefficient control block 31 is processed by another filter 37B having a response of $C_e(z)$. Response $C_e(z)$ has a phase response matched to response $C_x(z)$ of filter 37A. The input to filter 37B includes error microphone signal err and an inverted amount of downlink audio signal ds that has been processed by filter response SE(z) of filter 34A, of which response $SE_{COPY}(z)$ is a copy. Combiner 36 combines error microphone signal err and the inverted downlink audio signal ds. By injecting an inverted amount of downlink audio signal ds, adaptive filter 32 is prevented from adapting to the relatively large amount of downlink audio present in error microphone signal err and by transforming that inverted copy of downlink audio signal ds with the estimate of the response of path S(z), the downlink audio that is removed from error microphone signal err before comparison should match the expected version of downlink audio signal ds reproduced at error microphone signal err, since the electrical and acoustical path of S(z) is the path taken by downlink audio signal ds to arrive at error microphone E.

To implement the above, adaptive filter 34A has coefficients controlled by SE coefficient control block 33, which updates based on correlated components of downlink audio signal ds and an error value. The error value represents error microphone signal err after removal of the above-described filtered downlink audio signal ds, which has been previously filtered by adaptive filter 34A to represent the expected downlink audio delivered to error microphone E. The filtered version of downlink audio signal ds is removed from the output of adaptive filter 34A by combiner 36. SE coefficient control block 33 correlates the actual downlink speech signal ds with the components of downlink audio signal ds that are present in error microphone signal err. Adaptive filter 34A is thereby adapted to generate a signal from downlink audio signal ds, that when subtracted from error microphone signal err, contains the content of error microphone signal err that is not due to downlink audio signal ds.

Under certain circumstances, the anti-noise signal provided from adaptive filter 32 may contain more energy at certain frequencies due to ambient sounds at other frequencies, because W coefficient control block 31 has adjusted the frequency response of adaptive filter 32 to suppress the more energetic signals, while allowing the gain of other regions of the frequency response of adaptive filter 32 to rise, leading to a boost of the ambient noise, or "noise boost", in the other regions of the frequency response. In particular, response P(z) of the external acoustic path between reference microphone R and the error microphone E will generally include one or more multipath nulls at frequencies where the geometry of wireless telephone becomes significant with respect to the wavelength of sound. Since, due to the multi-path nulls, error microphone signal err will not contain energy correlated to the reference microphone signal ref at the frequencies of the nulls, the response of $W_{ADAPT}(z)$ will not model deep nulls due to the lack of excitation at those frequencies as W coefficient control block 31 acts to reduce the average energy of error microphone signal err for components present in reference microphone signal ref. In particular, noise boost is problematic if coefficient control block 31 adjusts the frequency response of adaptive filter 32 to suppress more energetic signals in higher frequency ranges, e.g., between 2 kHz and 5 kHz, where multi-path nulls in paths P(z) generally arise. Therefore, the amplitude portion of response $C_x(z)$ of filter 37A, the amplitude portion of response $C_e(z)$ of filter 37B, or both, are tailored to prevent coefficient control block 31 from boosting noise in one or more particular frequency ranges or particular discrete frequencies. Raising the gain of filter 37A and/or filter 37B at a particular frequency has the effect of increasing the degree to which the anti-noise signal will attempt to cancel the ambient audio at that frequency, while lowering the gain of filter 37A and/or filter 37B at a particular frequency reduces the degree to which the anti-noise signal attempts to cancel the ambient audio at that frequency. In order to preserve stability in the output of W coefficient control 31, response $C_e(z)$ of filter 37B will have a phase response matched to that of response $C_x(z)$ of filter 37A, irrespective of which of filters 37A and 37B has an amplitude response tailored to prevent or limit the above-described noise boost condition.

Figure 4:
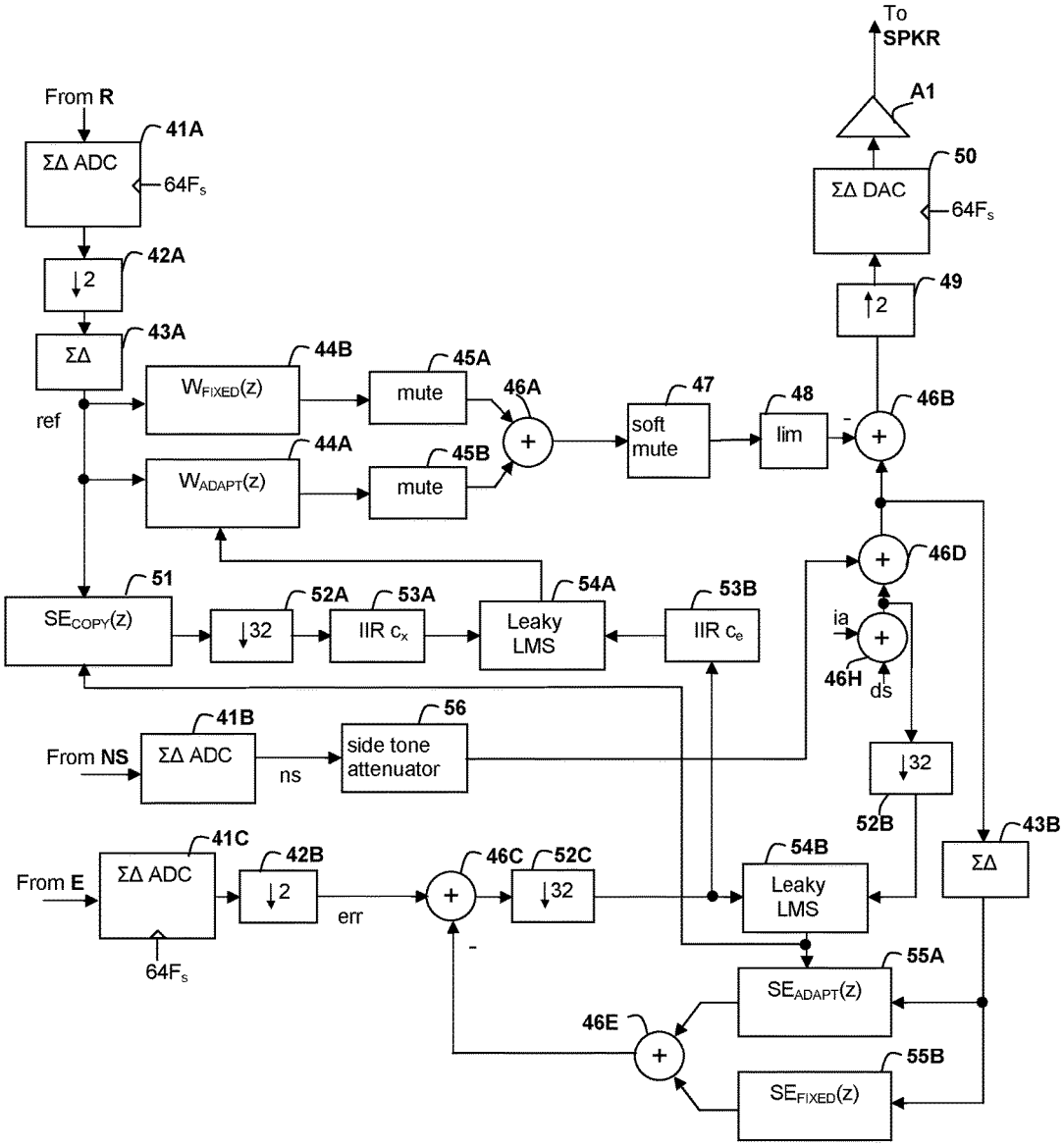
FIG. 4 is a block diagram depicting signal processing circuits and functional blocks within an integrated circuit in accordance with an embodiment of the present invention.

Referring now to FIG. 4, a block diagram of an ANC system is shown for illustrating ANC techniques in accordance with the embodiment of the invention as illustrated in FIG. 3, as may be implemented within CODEC integrated circuit 20. Reference microphone signal ref is generated by a delta-sigma ADC 41A that operates at 64 times oversampling and the output of which is decimated by a factor of two by a decimator 42A to yield a 32 times oversampled signal. A sigma-delta shaper 43A is used to quantize reference microphone signal ref, which reduces the width of subsequent processing stages, e.g., filter stages 44A and 44B. Since filter stages 44A and 44B are operating at an oversampled rate, sigma-delta shaper 43A can shape the resulting quantization noise into frequency bands where the quantization noise will yield no disruption, e.g., outside of the frequency response range of speaker SPKR, or in which other portions of the circuitry will not pass the quantization noise. Filter stage 44B has a fixed response $W_{FIXED}(z)$ that is generally predetermined to provide a starting point at the estimate of P(z)/S(z) for the particular design of wireless telephone 10 for a typical user. An adaptive portion, $W_{ADAPT}(z)$, of the response of the estimate of P(z)/S(z) is provided by adaptive filter stage 44A, which is controlled by a leaky least-means-squared (LMS) coefficient controller 54A. Leaky LMS coefficient controller 54A is leaky in that the response normalizes to flat or otherwise predetermined response over time when no error input is provided to cause leaky LMS coefficient controller 54A to adapt. Providing a leaky controller prevents long-term instabilities that might arise under certain environmental conditions, and in general makes the system more robust against particular sensitivities of the ANC response.

As in the system of FIGS. 2-3, and in the system depicted in FIG. 4, the reference microphone signal is filtered by a copy $SE_{COPY}(z)$ of the estimate of the response of path S(z), by a filter 51 that has a response $SE_{COPY}(z)$, the output of which is decimated by a factor of 32 by a decimator 52A to yield a baseband audio signal that is provided, through an infinite impulse response (IIR) filter 53A to leaky LMS 54A. The error microphone signal err is generated by a delta-sigma ADC 41C that operates at 64 times oversampling and the output of which is decimated by a factor of two by a decimator 42B to yield a 32 times oversampled signal. As in the systems of FIG. 3, an amount of downlink audio ds that has been filtered by an adaptive filter to apply response S(z) is removed from error microphone signal err by a combiner 46C, the output of which is decimated by a factor of 32 by a decimator 52C to yield a baseband audio signal that is provided, through an infinite impulse response (IIR) filter 53B to leaky LMS 54A. Infinite impulse response (IIR) filters 53A and 53B correspond to filters 37A and 37B in FIG. 3, and thus have a matched phase response and one or both of filters 37A and 37B has an amplitude response tailored to prevent noise boost by attenuating or amplifying one or more particular frequencies or frequency bands so that the coefficients determined by leaky LMS 54A do not boost noise at those particular frequencies or bands. For example, IIR filter 53A may include a single peak at 2.5 kHz to prevent noise boost around 2.5 kHz, and IIR filter 53B may have a flat amplitude response, but a phase response matching the filter response of IIR filter 53A.

Response S(z) is produced by another parallel set of filter stages 55A and 55B, one of which, filter stage 55B, has fixed response $SE_{FIXED}(z)$, and the other of which, filter stage 55A, has an adaptive response $SE_{ADAPT}(z)$ controlled by leaky LMS coefficient controller 54B. The outputs of filter stages 55A and 55B are combined by a combiner 46E. Similar to the implementation of filter response W(z) described above, response $SE_{FIXED}(z)$ is generally a predetermined response known to provide a suitable starting point under various operating conditions for electrical/acoustical path S(z). A separate control value is provided in the system of FIG. 4 to control filter 51, which is shown as a single filter stage. However, filter 51 could alternatively be implemented using two parallel stages and the same control value used to control adaptive filter stage 55A could then be used to control the adaptive stage in the implementation of filter 51. The inputs to leaky LMS control block 54B are also at baseband, provided by decimating a combination of downlink audio signal ds and internal audio ia, generated by a combiner 46H, by a decimator 52B that decimates by a factor of 32 after a combiner 46C has removed the signal generated from the combined outputs of adaptive filter stage 55A and filter stage 55B that are combined by another combiner 46E. The output of combiner 46C represents error microphone signal err with the components due to downlink audio signal ds removed, which is provided to LMS control block 54B after decimation by decimator 52C. The other input to LMS control block 54B is the baseband signal produced by decimator 52B.

The above arrangement of baseband and oversampled signaling provides for simplified control and reduced power consumed in the adaptive control blocks, such as leaky LMS controllers 54A and 54B, while providing the tap flexibility afforded by implementing adaptive filter stages 44A-44B, 55A-55B and adaptive filter 51 at the oversampled rates. The remainder of the system of FIG. 4 includes combiner 46H that combines downlink audio ds with internal audio ia, the output of which is provided to the input of a combiner 46D that adds a portion of near-end microphone signal ns that has been generated by sigma-delta ADC 41B and filtered by a sidetone attenuator 56 to provide a correct perception of the user's voice during telephone conversations. The output of combiner 46D is shaped by a sigma-delta shaper 43B that provides inputs to filter stages 55A and 55B that has been shaped to shift images outside of bands where filter stages 55A and 55B will have significant response.

In accordance with an embodiment of the invention, the output of combiner 46D is also combined with the output of adaptive filter stages 44A-44B that have been processed by a control chain that includes a corresponding hard mute block 45A, 45B for each of the filter stages, a combiner 46A that combines the outputs of hard mute blocks 45A, 45B, a soft mute 47 and then a soft limiter 48 to produce the anti-noise signal that is subtracted by a combiner 46B with the source audio output of combiner 46D. The output of combiner 46B is interpolated up by a factor of two by an interpolator 49 and then reproduced by a sigma-delta DAC 50 operated at the 64× oversampling rate. The output of DAC 50 is provided to amplifier A1, which generates the signal delivered to speaker SPKR.

Each or some of the elements in the system of FIG. 4, as well in as the exemplary circuits of FIG. 2 and FIG. 3, can be implemented directly in logic, or by a processor such as a digital signal processing (DSP) core executing program instructions that perform operations such as the adaptive filtering and LMS coefficient computations. While the DAC and ADC stages are generally implemented with dedicated mixed-signal circuits, the architecture of the ANC system of the present invention will generally lend itself to a hybrid approach in which logic may be, for example, used in the highly oversampled sections of the design, while program code or microcode-driven processing elements are chosen for the more complex, but lower rate operations such as computing the taps for the adaptive filters.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A personal audio device, comprising:

a personal audio device housing;

a transducer mounted on the housing that reproduces an audio signal including both source audio for playback to a listener and an anti-noise signal to counter the effects of ambient audio sounds in an acoustic output of the transducer;

a reference microphone mounted on the housing that generates a reference microphone signal indicative of the ambient audio sounds;

an error microphone mounted on the housing in proximity to the transducer that generates an error microphone signal indicative of the acoustic output of the transducer and the ambient audio sounds at the transducer; and a processing circuit that implements a first adaptive filter having a response that generates the anti-noise signal from the reference microphone signal to reduce the presence of the ambient audio sounds heard by the listener, wherein the processing circuit shapes the response of the first adaptive filter in conformity with the error microphone signal and the reference microphone signal by adapting the response of the first adaptive filter to minimize the ambient audio sounds at the error microphone according to coefficients generated by a coefficient control that receives an error signal derived from the error microphone signal, wherein the error signal is filtered by a filter implemented by the processing circuit to weight one or more particular frequency regions within the response of the first adaptive filter before being provided to the coefficient control, wherein the coefficient control computes the coefficients by correlating the error signal with the reference microphone signal, wherein the filter filters the error signal to weight a frequency content of the error signal to compensate for a frequency response of an external acoustic path between the reference microphone and the error microphone by causing the coefficients to be adjusted to increase or decrease the degree to which the anti-noise signal cancels the ambient audio sounds in the one or more particular frequency regions relative to the degree to which the anti-noise signal cancels the ambient audio sounds in other frequency regions by respectively increasing or decreasing a gain applied to the error signal in the one or more particular frequency regions relative to gain applied to the other frequency regions within the response of the first adaptive filter, wherein the processing circuit further implements a secondary path filter having a response that generates a shaped source audio signal and a combiner that subtracts the shaped source audio signal from the error microphone signal to generate the error signal, wherein the combiner cancel components of the source audio signal present in the error microphone signal in order to prevent the first adaptive filter from cancelling components of the source audio signal when generating the anti-noise signal.

2. The personal audio device of claim 1, wherein a phase response of another signal derived from the reference microphone signal is adjusted to compensate for the weighting of the error signal.

3. The personal audio device of claim 2, wherein an equal weighting is applied to the another signal derived from the reference microphone signal and the error signal.

4. The personal audio device of claim 1, wherein the frequency response of the external acoustic channel has one or more multipath nulls, and wherein the error signal is weighted to adjust the shape of the response of the first adaptive filter in the one or more particular frequency regions corresponding to the one or more multipath nulls.

5. The personal audio device of claim 1, wherein the personal audio device is a wireless telephone further comprising a transceiver for receiving the source audio as a downlink audio signal.

6. A method of canceling ambient audio sounds in the proximity of a transducer of a personal audio device, the method comprising:

first measuring ambient audio sounds with a reference microphone to produce a reference microphone signal;

second measuring an output of the transducer and the ambient audio sounds at the transducer with an error microphone;

adaptively generating an anti-noise signal from a result of the first measuring and the second measuring to minimize the effects of ambient audio sounds at the error microphone by adapting a response of a first adaptive filter that filters an output of the reference microphone;

combining the anti-noise signal with a source audio signal to generate an audio signal provided to the transducer;

generating a shaped source audio signal from the source audio signal to minimize cancellation of the source audio sounds at the error microphone by filtering the source audio signal to generate the shaped source audio;

subtracting the shaped source audio signal from the error microphone signal to generate an error signal, wherein the subtracting cancels components of the source audio signal present in the error microphone signal from appearing in the error signal, in order to prevent the first adaptive filter from cancelling components of the source audio signal when generating the anti-noise signal;

filtering the error signal to weight one or more particular frequency regions within the response of the first adaptive filter by increasing or decreasing the gain applied to the error signal in one or more particular frequency regions, wherein the filtering weights frequency content of the error signal to compensate for a frequency response of an external acoustic path between the reference microphone and the error microphone; and providing a result of the filtering to a coefficient control of the first adaptive filter to shape the amplitude response of the first adaptive filter by correlating the result of the filtering with the reference microphone signal to generate coefficients that control the amplitude response of the first adaptive filter, so that, respective to and in conformity with the increasing or decreasing of the gain applied to the error signal in the one or more particular frequency regions relative to gain applied to other frequency regions within the response of the first adaptive filter, the coefficients are adjusted to increase or decrease the degree to which the anti-noise signal cancels the ambient audio sounds in the one or more particular frequency regions relative to the degree to which the anti-noise signal cancels the ambient audio sounds in the other frequency regions.

7. The method of claim 6, further comprising adjusting a phase response of another signal derived from the reference microphone signal to compensate for the weighting of the error signal by the filtering.

8. The method of claim 7, wherein the filtering applies an equal weighting to the another signal derived from the reference microphone signal and the error signal.

9. The method of claim 6, wherein the frequency response of the external acoustic channel has one or more multipath nulls, and wherein the filtering weights the error signal to adjust the shape of the response of the first adaptive filter in the one or more particular frequency regions corresponding to the one or more multipath nulls.

10. The method of claim 6, wherein the personal audio device is a wireless telephone, and wherein the method further comprises receiving the source audio as a downlink audio signal.

11. An integrated circuit for implementing at least a portion of a personal audio device, comprising:

an output for providing a signal to a transducer including both source audio for playback to a listener and an anti-noise signal for countering the effects of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer; and a processing circuit that implements a first adaptive filter having a response that generates the anti-noise signal from the reference microphone signal to reduce the presence of the ambient audio sounds heard by the listener, wherein the processing circuit shapes the response of the first adaptive filter in conformity with the error microphone signal and the reference microphone signal by adapting the response of the first adaptive filter to minimize the ambient audio sounds at the error microphone—according to coefficients generated by a coefficient control that receives an error signal derived from the error microphone signal, wherein the error signal is filtered by a filter implemented by the processing circuit to weight one or more particular frequency regions within the response of the first adaptive filter before being provided to the coefficient control, wherein the coefficient control computes the coefficients by correlating the error signal with the reference microphone signal, wherein the filter filters the error signal to weight a frequency content of the error signal to compensate for a frequency response of an external acoustic path between the reference microphone and the error microphone by causing the coefficients to be adjusted to increase or decrease the degree to which the anti-noise signal cancels the ambient audio sounds in the one or more particular frequency regions relative to the degree to which the anti-noise signal cancels the ambient audio sounds in other frequency regions by respectively increasing or decreasing a gain applied to the error signal in the one or more particular frequency regions relative to gain applied to the other frequency regions within the response of the first adaptive filter, wherein the processing circuit further implements a secondary path filter having a response that generates a shaped source audio signal and a combiner that subtracts the shaped source audio signal from the error microphone signal to generate the error signal, wherein the combiner cancels components of the source audio signal present in the error microphone signal in order to prevent the first adaptive filter from cancelling components of the source audio signal when generating the anti-noise signal.

12. The integrated circuit of claim 11, wherein a phase response of another signal derived from the reference microphone signal is adjusted to compensate for the weighting of the error signal.

13. The integrated circuit of claim 12, wherein an equal weighting is applied to the another signal derived from the reference microphone signal and the error signal.

14. The integrated circuit of claim 11, wherein the frequency response of the external acoustic channel has one or more multipath nulls, and wherein the error signal is weighted to adjust the shape of the response of the first adaptive filter in the one or more first particular frequency regions corresponding to the one or more multipath nulls.

* * * * *